United States Patent [19]

Hiromura

[11] Patent Number: 4,998,545

[45] Date of Patent: Mar. 12, 1991

[54] PORTABLE SHAVING BRUSH

[76] Inventor: Paul Hiromura, 596 Warwick Ave., Teaneck, N.J. 07666

[21] Appl. No.: 472,358

[22] Filed: Jan. 30, 1990

[51] Int. Cl.[5] ..... A45D 27/16

[52] U.S. Cl. ..... 132/290; 132/289

[58] Field of Search ..... 132/289, 290, 291, 292

[56] References Cited

U.S. PATENT DOCUMENTS

| | | | |
|---|---|---|---|
| 1,213,352 | 1/1917 | Grady | 132/290 |
| 1,298,633 | 4/1919 | Alland | 132/290 |
| 1,357,679 | 11/1920 | Ball | 132/290 |
| 1,491,292 | 4/1924 | Ebert | 132/289 |
| 1,571,556 | 2/1926 | Nyhagen | 132/289 |
| 1,932,603 | 10/1933 | Richardson | 132/289 |
| 3,093,857 | 6/1963 | Hersh | 132/290 |
| 3,231,923 | 2/1966 | Gaines | 132/290 |
| 4,144,967 | 3/1979 | Craven et al. | 132/290 |

FOREIGN PATENT DOCUMENTS

| | | | |
|---|---|---|---|
| 510426 | 1/1957 | Italy | 132/289 |
| 235059 | 6/1926 | United Kingdom | 132/289 |

*Primary Examiner*—John J. Wilson
*Assistant Examiner*—F. LaViola
*Attorney, Agent, or Firm*—Eliot S. Gerber

[57] ABSTRACT

A portable shaving brush assembly that comprises a brush for applying shaving cream, a hollow handle portion and a can of shaving cream removably stored in the hollow handle. The shaving brush is covered by a removable funnel-shaped shield having a hinged cap and multiple ventilation holes to allow the brush to dry when stored after use. The hollow handle has a can holder cap which closes the storage end of the handle. The shaving cream can and can holder cap are removed as a single unit during use.

2 Claims, 1 Drawing Sheet

PORTABLE SHAVING BRUSH

BACKGROUND OF THE INVENTION

1. Field of the Invention

The present invention relates to shaving brushes.

2. Description of the Related Art

At the present time most men prefer to shave using a razor and lather rather than an electric shaver. Although shaving cream may be obtained using the foam from a pressure can and applied directly to the face, there are many men who prefer to obtain their shaving lather using a wet shaving brush.

However, shaving brushes present a problem when traveling. Often, as an expedient, the user will wrap the wet or damp shaving brush in aluminum foil, plastic wrap or paper. The process of wrapping the brush may be messy and time-consuming. The wrapped brush, if wet, may leak on the traveler's clothes or, if in a toiletry bag, it may leak on the other items in the bag. In addition, the brush uses soft bristles which may be damaged by being squeezed against other items.

If the brush is tightly wrapped to prevent leakage, it may not dry in time for its re-use the next day. Furthermore, such treatment of the brush, repeated over time, is detrimental to the quality of the brush and can cause a weakening in the seating of the brush fibers, thereby resulting in brush fiber loss. Another problem, though not inherent to the shaving brush, is the need to carry along a mug or other portable container into which a solid shaving cream bar is placed to work up a shaving lather.

OBJECTIVES AND FEATURES OF THE INVENTION

It is an objective of the present invention to provide a shaving brush which may be used for traveling.

It is a further objective of the present invention to provide such a shaving brush that may be packed without its leaking and without its bristles being crushed.

It is a further objective of the present invention to provide such a shaving brush which will dry, although packed in a suitcase, toiletry bag or other container.

It is a further objective of the present invention to provide such a shaving brush which will retain its bristles in a soft and flexible state so that the brush is ready to be re-used.

It is a further objective of the present invention to provide such a shaving brush that may be dried, and stored after drying, in an upright position (with the shaving brush head facing down) which is the care recommended by quality shaving brush manufacturers.

It is a further objective of the present invention to provide such a shaving brush with a self-contained shaving cream supply which, when applied to the (wetted) shaving brush and then rubbed against the skin, will result in a rich shaving lather.

BRIEF DESCRIPTION OF THE DRAWINGS

Other objectives and features of the present invention will be apparent from the following detailed description, providing the inventor's best mode of practicing the invention. The description should be read in conjunction with the accompanying drawings.

In the drawings.

DETAILED DESCRIPTION

Figure 1:
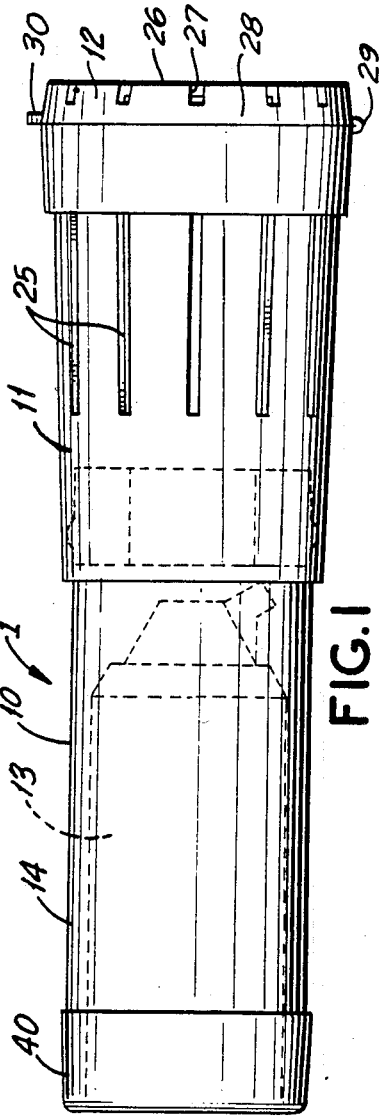
FIG. 1 is a side view of the shaving brush assembly.

As shown in FIG. 1, the portable shaving brush device 1 of the present ivention comprises a brush assembly, a tubular shield cover 11; a cap 12 hinged to the cover 11; a shaving cream aerosol can assembly 13; a brush holder tube 14 and a cap can holder 40.

Figure 3:
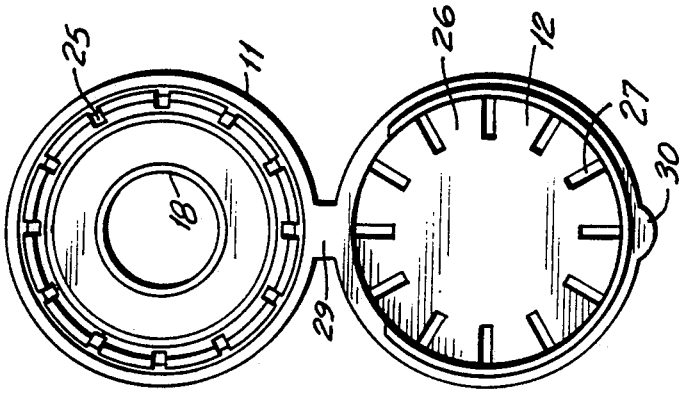
FIG. 3 is a top view of the brush assembly and its cap.
Figure 2:
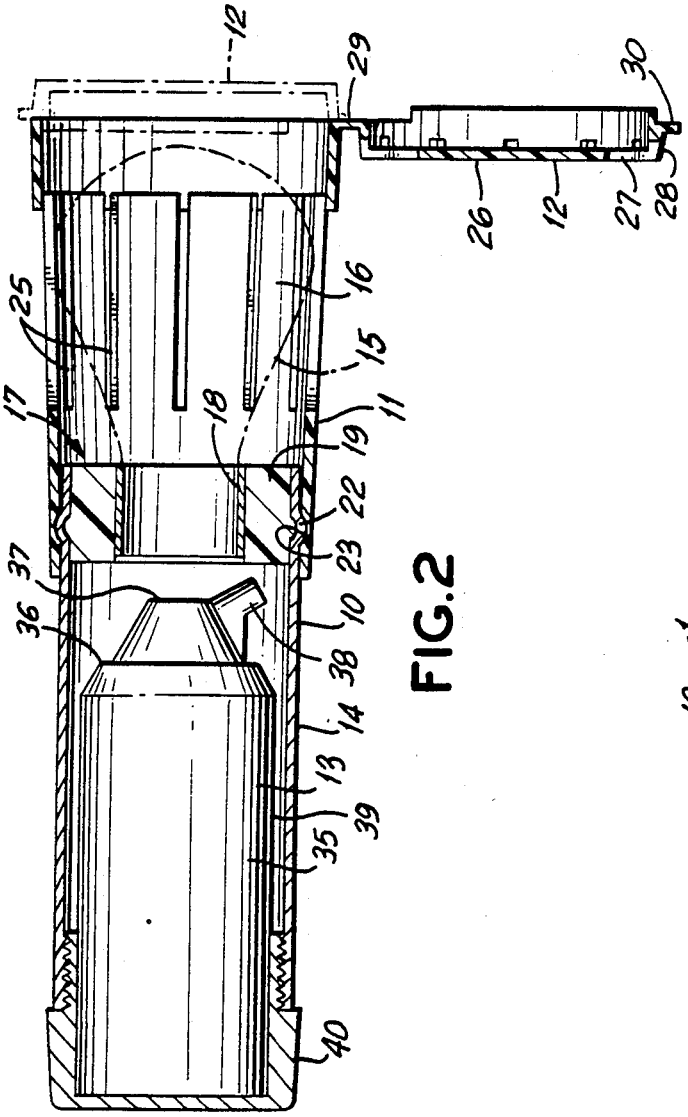
FIG. 2 is a side cross-sectional view of the brush assembly of FIG. 1.

The brush assembly 10, as shown in FIG. 2, comprises a conventional multi-bristle brush 15 having bristles 16, preferably of natural badger hair, other animal hair, or alternatively of plastic material. A head 17 holds one end of the bristles. The head 17 includes a metal band 18 containing the ends of the bristle and plastic holding the bristles, and an annular plastic ring 19. The head 17 is retained within one end of the brush holder tube 14 and is fixed thereto. The tube 14 has an outer annular bump 22 which snap-fits into an annular depression 23 of the tubular cover 11. The tube 14 is a tubular member, preferably of stainless steel, and is the handle of the brush assembly 10.

The cover 11 is tubular, outwardly tapered, and has open elongated slots 25 for drying the brush. The cover 11 and the cap is a unitary one-piece member molded from plastic resin, preferably polypropylene.

The cap 12 has a flat top portion 26 with open slots 27 therein, an inwardly tapered skirt portion 28, and a lift tab 30. The slots 25 and 27 permit air to reach the brush. The cap 12, at one of its ends, has a plastic resin hinge 29, i.e., a "living hinge", which hinges the cap 12 on the cover 11.

The aerosol can 35 contains shave cream under pressure. It includes an end wall portion 36 haivng a finger-operated valve 37 with an outlet spout 38 and a cylindrical body portion 39.

In use, the user will remove the shaving brush by gently pulling apart the shaving brush holder tube 14 from the shield cover 11. To gain access to the shaving cream, the user gently pulls apart the cap can holder 40 from the shaving brush holder tube 14. He will then rinse the shaving brush head in hot water until thoroughly hot and wet and shake the shaving brush 15 once or twice to remove excess water. He then holds the cap can holder 40 (which contains the aerosol can 35) in the other hand and presses a small amount of shaving cream onto the head of the shaving brush. The cap can holder 40 is then replaced into the open end of the shaving brush holder tube 14.

The user will then rub the shaving brush on his face to produce a rich lather. If more lather is required during the shave, the shaving brush may be re-rubbed onto the desired facial area. This will again produce a rich lather, enough to finish the shave.

After use, the shaving brush is rinsed to remove residual lather and shaken vigorously to remove excess water. The user will then flip open the cap 12 of the shaving brush shield cover 11 and insert the shaving brush holder tube 14, handle end first, until the tube 14 snaps securely in place. The user will then set the travel shaft brush unit upright (with the shaving brush 15 facing downward). The air flow through the shield cover 11 will dry the shaving brush 15. If traveling, the travel shaving brush unit will be packed into the user's toiletry kit/luggage. While in transit, the air flow through the cover 11 will dry the brush 15 for its next use.

I claim:

1. A portable shaving brush assembly including:

(a) a handle assembly including a cylindrical hollow tubular member forming a handle and having opposite first and second open ends;

(b) said handle assembly including an annular member connected at one end of said tubular member;

(c) a brush comprising flexible bristles, one end of said brush being held with said annular member and the opposite end being a free end;

(d) a shield cover having holes therethrough, said cover being tubular, funnel shaped and fitting over said brush and being removable connected to said handle assembly, said funnel shaped shield cover having a larger diameter open end proximate the free end of the brush and a smaller diameter open end proximate said handle assembly;

(e) a cap hinged to said shield cover and removably positioned to cover one end thereof;

(f) a shave cream can filled with shaving cream and having a cylindrical end, said can removably positioned within the hollow of said tubular handle member; and (g) a can holder cap which grips and holds said can end and and is removable from said handle member as a unit with said can and is removably connected to the second end of said tubular handle member.

2. A shaving brush as in claim 1 wherein said can includes a hollow body member having a right cylindrical side wall and an end wall having a finger-operated valve means with an orifice therethrough.

* * * * *